US005608383A

United States Patent [19]

Neil

[11] Patent Number: 5,608,383

[45] Date of Patent: Mar. 4, 1997

[54] AUTOMATIC TEMPERATURE ALARM SYSTEM

[76] Inventor: Clifford R. Neil, 39 Ora St., Pittsfield, Mass. 01201

[21] Appl. No.: 412,998

[22] Filed: Mar. 29, 1995

[51] Int. Cl.[6] ..... G08B 17/00

[52] U.S. Cl. ..... 340/588; 99/344; 374/102

[58] Field of Search ..... 340/584, 588, 340/529, 309.15, 522; 374/102; 99/342, 344, 325; 219/627, 449, 494, 506, 510; 431/13

[56] References Cited

U.S. PATENT DOCUMENTS

| | | | |
|---|---|---|---|
| 3,614,278 | 10/1971 | DiNoto, Jr. | 431/16 |
| 4,775,913 | 10/1988 | Ekblad | 219/519 X |
| 4,864,283 | 9/1989 | Seto | 340/584 |
| 4,922,220 | 5/1990 | Hseih et al. | 340/521 |
| 5,382,939 | 1/1995 | Hong | 219/506 X |

*Primary Examiner*—Thomas Mullen
*Attorney, Agent, or Firm*—Malcolm J. Chisholm, Jr.

[57] ABSTRACT

An automatic temperature alarm system is disclosed for alerting an operator of a heated apparatus that the apparatus has been heated and untouched for an excessive period of time. In a particular embodiment, the invention comprises a temperature sensor affixed to the heated apparatus that senses its temperature; a vibration sensor that senses motion of the apparatus; a horn to alert the operator; and a system control intelligence in communication with the temperature and vibration sensors and horn for setting an alarm timer to measure an alarm period in response to sensed temperatures and motions and for activating the horn upon expiration of the alarm period. In use of the automatic temperature alarm system, the system control intelligence is operated so that whenever the temperature sensor senses an increase beyond a specific high or trigger temperature, such as a heating temperature of an outdoor barbecue, the system control intelligence sets its alarm timer to commence measurement of the alarm period of time, and upon the expiration of the alarm period of time, for example twenty minutes, the system control intelligence activates the horn. If the system control intelligence senses a motion of the apparatus from the vibration sensor during the alarm period of time, however, it re-sets its alarm timer to re-commence measurement of the alarm period of time. If the horn has been activated, the system control intelligence inactivates it upon sensing any apparatus motion from the vibration sensor.

10 Claims, 4 Drawing Sheets

AUTOMATIC TEMPERATURE ALARM SYSTEM

TECHNICAL FIELD

The present invention relates to temperature alarm systems for heated apparatus, and especially relates to an automatic temperature alarm system for alerting an operator of a cooking apparatus, such as an outdoor barbecue, that the apparatus has been heated and untouched for an excessive period of time.

BACKGROUND OF THE INVENTION

When utilizing a heated apparatus such as an ordinary outdoor, gas-fired barbecue device to cook foods, it is common to allow the barbecue to become heated for a warm-up period prior to using it so that charcoal or similar heat elements in the barbecue distribute heat evenly. Additionally, because barbecues are often used to cook more food than the barbecue can hold at one time, operators do not develop a habit of turning off their burners and gas supply after each use, in order to allow the barbecue to remain warm and ready for a second round of cooking. Moreover, after use of the barbecue, it is often heated to a higher temperature than a cooking temperature, in order to assist in cleaning internal cooking grills and related components.

Because barbecues are frequently stored and used in areas remote from food preparation and/or eating areas, a hazard of barbecue use is that an operator may forget that the barbecue is being warmed up; left on for additional cooking; or, left in a high-temperature, grill cleaning setting. Not only does such a hazard result in an uneconomical loss of the value of wasted gas, it also poses a substantial safety risk, due to the exposure of a high-temperature, unattended barbecue to children, pets, and flammable materials.

Known alarm systems that could minimize the risk of such hazards involve mechanical spring-based timers, that deteriorate as a result of weather exposure, and require the barbecue operator to re-set the alarm with each use of the barbecue, a task that would be overlooked by most operators. Consequently, an alarm system that signals barbecue operators that the barbecue has been heated and untouched for an excessive period of time has not gained wide-spread acceptance.

Accordingly it is the general object of the present invention to provide an automatic temperature alarm system that overcomes the durability and use requirement problems of the prior art.

It is a more specific object to provide an automatic temperature alarm system for use with heated apparatus such as an outdoor barbecue that automatically alerts the operator of the apparatus that the apparatus has been heated and untouched for an excessive period of time.

It is another specific object to provide an automatic temperature alarm system that can be stored outdoors for extended periods without deterioration due to weather stresses.

It is yet another object to provide an automatic temperature alarm system that utilizes a minimal amount of energy when the system is not being used.

The above and other advantages of this invention will become more readily apparent when the following description is read in conjunction with the accompanying drawings.

DISCLOSURE OF THE INVENTION

An automatic temperature alarm system is disclosed for alerting an operator of a heated apparatus that the apparatus has been heated and untouched for an excessive period of time. In a particular embodiment, the invention comprises a temperature sensor affixed to the heated apparatus that senses its temperature; a vibration sensor that senses motion of the apparatus; a horn to alert the operator; and a system control intelligence means in communication with the temperature and vibration sensors and horn for setting an alarm timer to measure an alarm period in response to sensed temperatures and motions and for activating the horn upon expiration of the alarm period.

In use of the automatic temperature alarm system, the system control intelligence means is set so that whenever the temperature sensor senses an increase beyond a specific high or trigger temperature, such as a heating temperature of an outdoor barbecue, the intelligence means interprets that trigger temperature to set its alarm timer to commence measurement of the alarm period of time, and upon the expiration of the alarm period of time, for example twenty minutes, the intelligence means activates the horn. If the system control intelligence senses a motion of the apparatus from the vibration sensor during the alarm period of time, however, it re-sets its alarm timer to re-commence measurement of the alarm period of time. Whenever the temperature sensor senses that the temperature of the apparatus has descended below the trigger temperature, the intelligence means deactivates its alarm timer. If the horn has been activated, the intelligence means inactivates it upon sensing any apparatus motion from the vibration sensor. In a preferred embodiment, the system control intelligence means is a microcontroller in communication with the temperature and vibration sensors and the horn, and the alarm timer includes a program in a program memory of the microcontroller.

DETAILED DESCRIPTION OF THE REFERRED EMBODIMENTS

Figure 1:
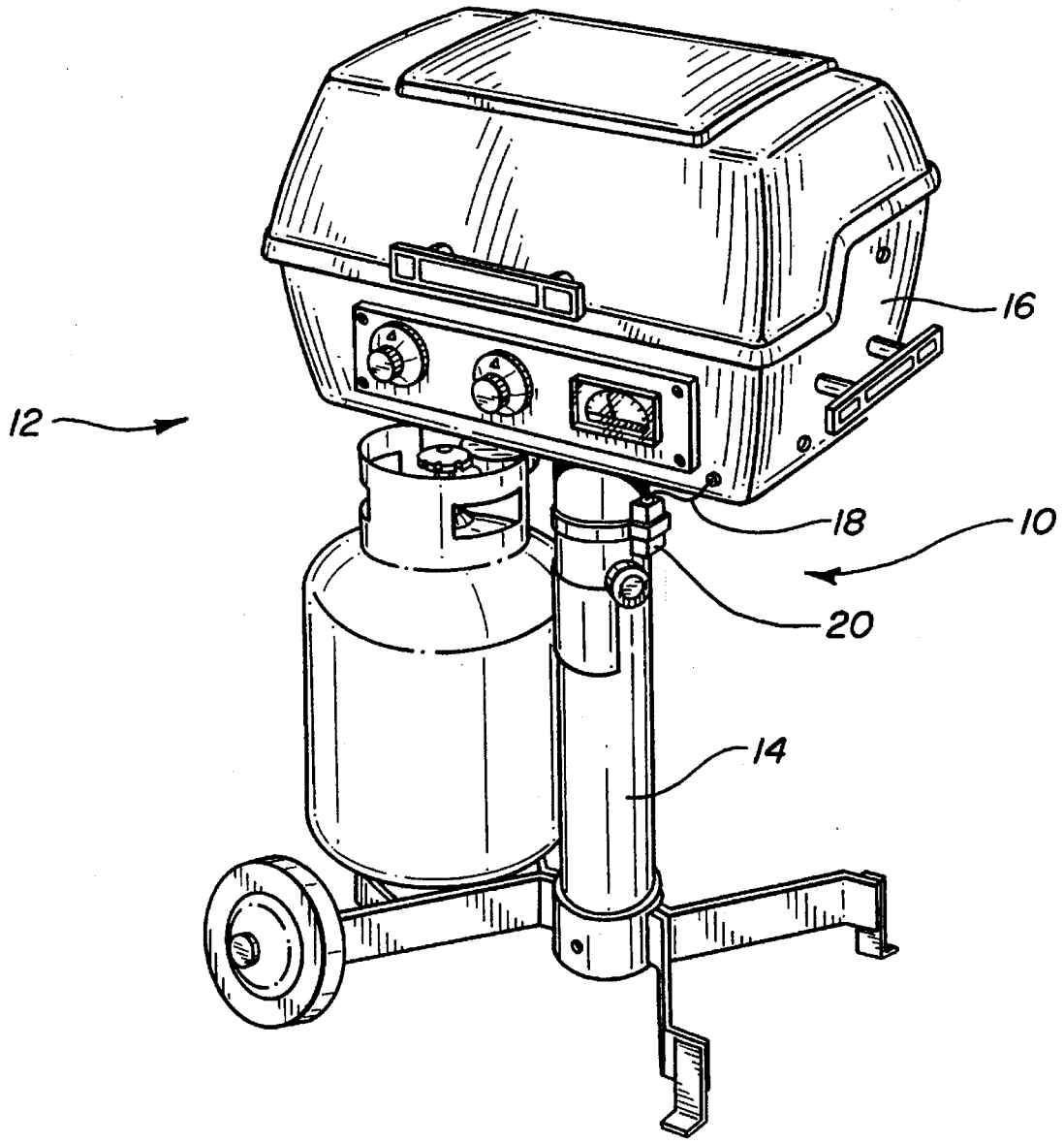
FIG. 1 is a perspective view of an automatic temperature control system constructed in accordance with the present invention affixed to an outdoor, gas-fired barbecue apparatus.
Figure 2:
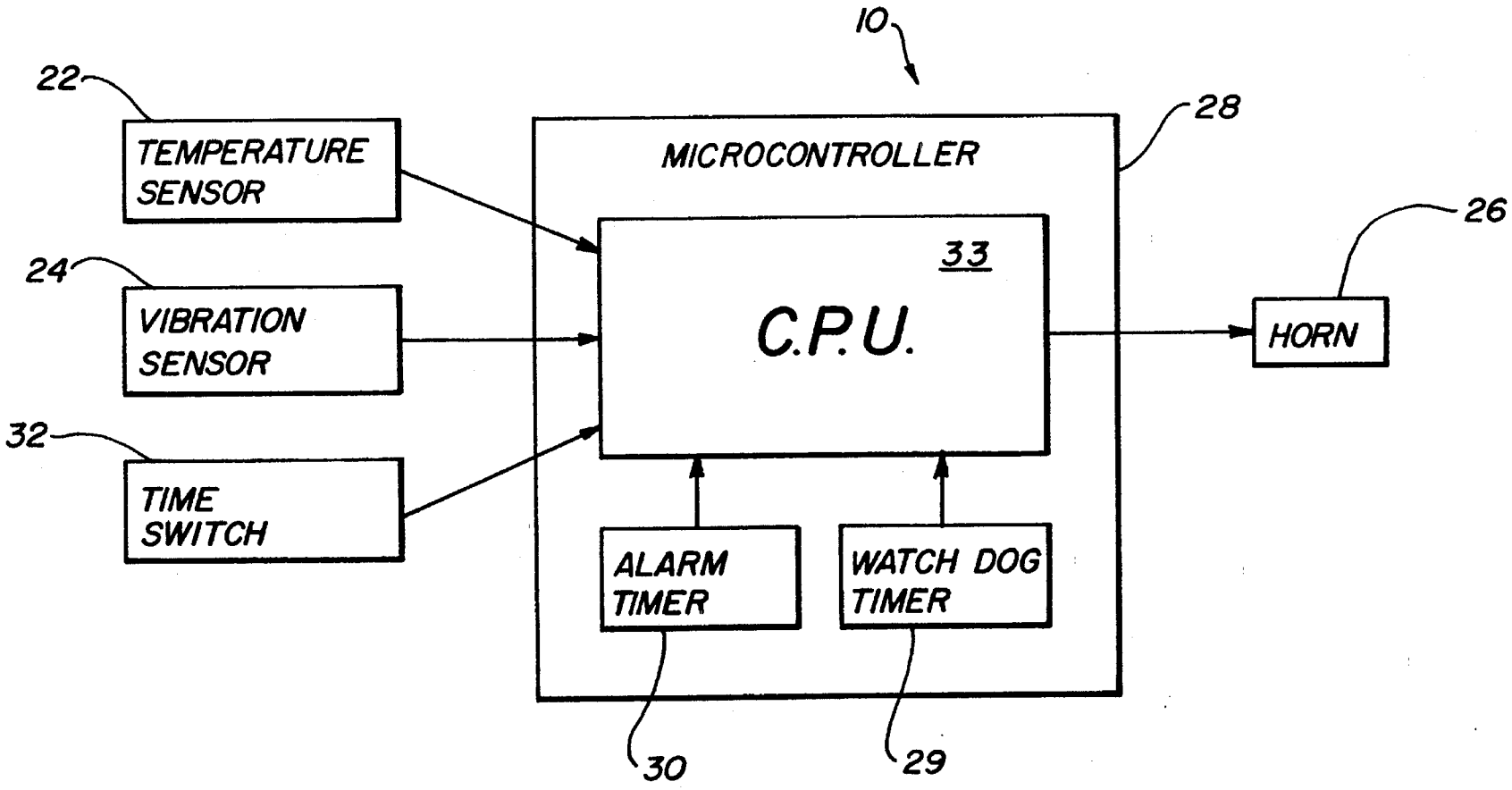
FIG. 2 is a schematic representation of the components of the FIG. 1 automatic temperature control system.

Referring to the drawings in detail, an automatic temperature alarm system is shown in FIGS. 1 and 2, and generally designated by the reference numeral 10. As best seen in FIG. 1, an appropriate working environment for the automatic temperature alarm system 10 is retro-fitted to a heated apparatus such as a standard outdoor barbecue 12 having a support post 14 to hold a heated cooking housing 16, to which post 14 the automatic temperature alarm system 10 is affixed. A temperature sensor lead 18 extends from an alarm system housing 20 to a temperature sensor 22 (shown schematically in FIG. 2) secured to the heated cooking housing 16 of the barbecue 12.

As best seen in FIG. 2, the automatic temperature alarm system 10 basically comprises the temperature sensor 22 secured to a heated apparatus such as the housing 16 that senses its temperature; a vibration sensor 24 that senses motion of the apparatus 16; a horn 26 to alert an operator (not shown) of the heated apparatus; and, a system control intelligence means, such as microcontroller 28, in communication with the temperature and vibration sensors 22, 24 and horn 26 for setting an alarm timer 30 to measure an alarm period in response to sensed temperatures or motions and for activating the horn upon expiration of the alarm period.

A satisfactory microcontroller 28 may be Part No. PIC16C54, manufactured by Microchip Technology, Inc. of Chandler, Ariz. The microcontroller 28 includes a standard watchdog timer 29 and alarm timer 30. The temperature sensor 22 may be a sensor Model No. PN 271-11, as manufactured and sold by RADIO SHACK, a Division of TANDY Corporation, of Fort Worth, Tex. The vibration sensor 24 may be a sensor Model No. Series 5008, manufactured by Signal Systems, International, Inc., of Lavallete, N.J. And, the horn 26 may be a horn Model No. PN 273-073 as manufactured and sold by RADIO SHACK, a Division of TANDY Corporation, of Fort Worth, Tex.

Additionally, as shown in FIG. 2, a time switch 32 may be in communication with the microcontroller 28 in order to adjustably set the microcontroller's alarm timer 30 to alarm periods of differing durations. An appropriate time switch 32 may be Model No. CT20610-ND, manufactured by CTS, Inc., of Bernie, Ind. The microcontroller includes a standard Central Processing Unit ("C.P.U.") 33.

In fabrication of a working example (not shown) of the automatic temperature alarm system 10 of the present invention utilizing the aforesaid Part No. PIC-16C54, manufactured by Microchip Technology, Inc. of Chandler, Ariz. as the microcontroller and the other components specifically identified above, a power source for operation of the invention is used that includes three standard "AA", 1.5 volt batteries (not shown) which are electrically connected in series to provide a positive and negative terminal of the power source. The positive terminal is connected to pin no. 14 (the respective "pin numbers" of the herein described working embodiment utilizing the aforesaid specific microcontroller 28 are herein referred to as "pin no. 14", etc., and are not to be confused with the reference numerals of the components in the drawings which do not have the prefix "pin no.") of microcontroller 28 while a negative terminal of the power source is connected to the same ground to which the microcontroller pin no. 5 is connected. The temperature sensor 22 is electrically connected to microcontroller pin nos. 17 and 18, and pin no. 18 is also connected to an approximately 4000 ohm resistor which resistor is connected to the ground. Time switch 32 includes four single pole switches having two lines each, and each switch has one line tied to the ground and the other four lines are electrically connected to pin nos. 6, 7, 8, and 9 of the microcontroller. The horn 26 is electrically connected to ground by one of its two contacts, and the other contact is electrically connected to a 1000 ohm resistor, and the resistor is electrically connected to microcontroller pin no. 13. The vibration sensor 24 is electrically connected to the ground by one of its two contacts, and the other contact is electrically connected to microcontroller pin no. 4, which pin no. 4 also has a 330 ohm resistor in series with a light emitting diode which is electrically connected to the positive terminal of the power source. Pin no. 16 of the microcontroller is electrically connected to a 1000 ohm resistor with another side of the resistor electrically connected to the positive terminal of the power source, and a 100 picofarad capacitor is electrically connected to microcontroller pin no. 16 and to the ground.

Figure 3A:
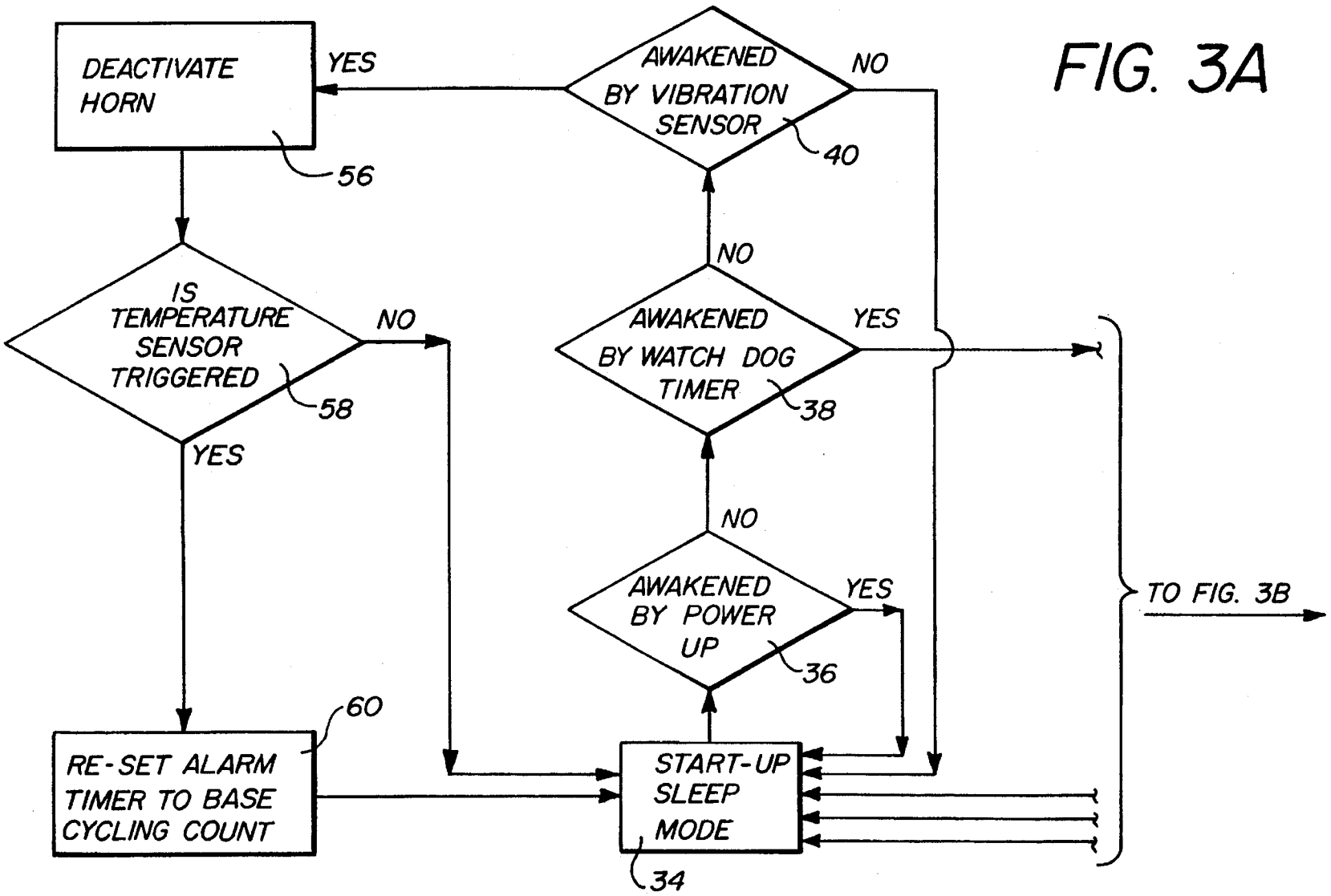
FIGS. 3*a* and 3*b* are a logic flow chart of a system control intelligence that implements the automatic temperature control system of the present invention.
Figure 3B:
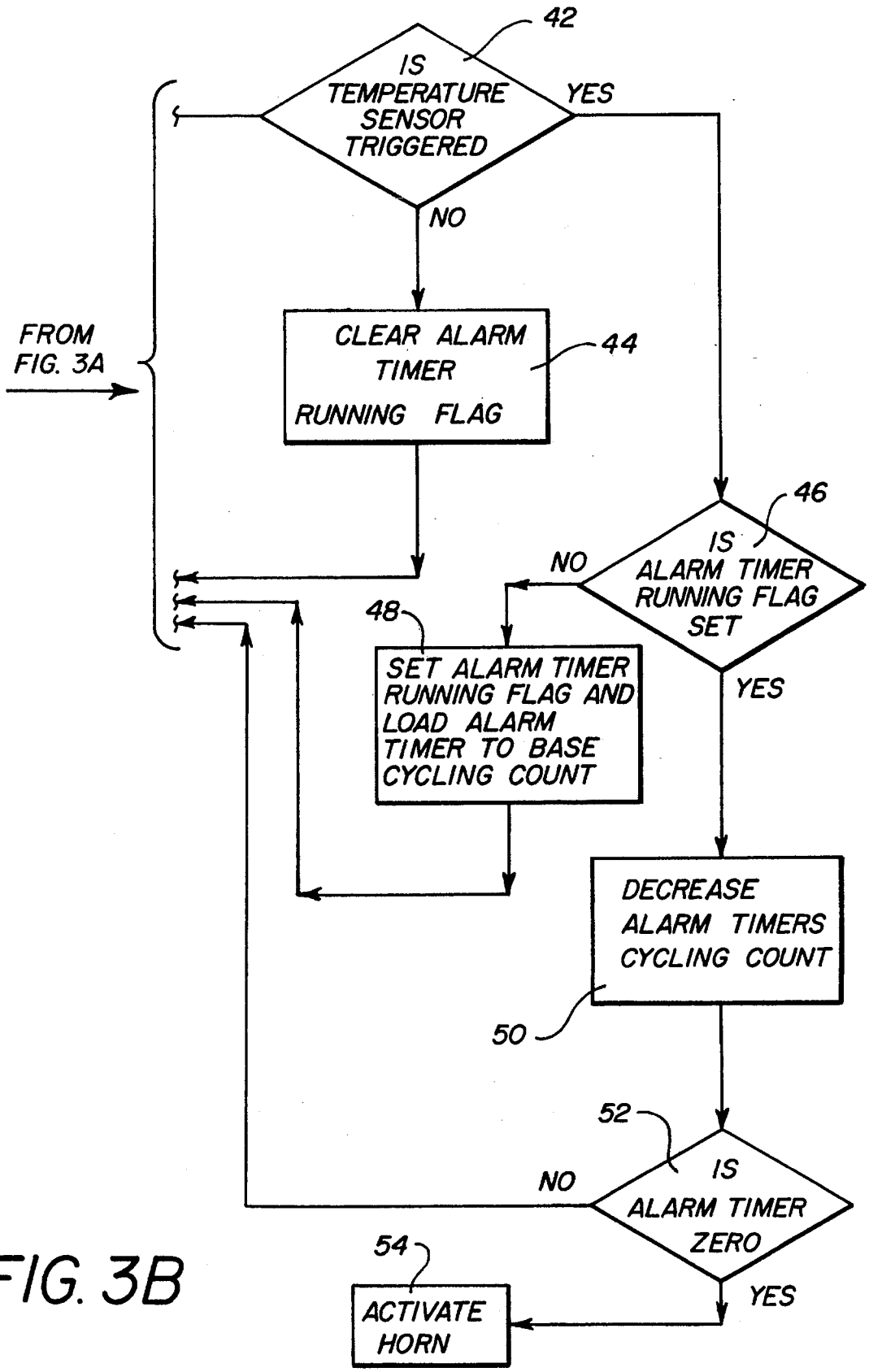

Operation of the microcontroller or system control intelligence means 28 to implement the automatic temperature alarm system 10 is shown in the logic flow chart of FIGS. 3*a* and 3*b*, wherein rectangular blocks represent system control intelligence tasks or states (hereafter "task or state blocks"), and parallelogram blocks represent system control intelligence decisions (hereafter "decision blocks"). Explanation of the operation of the system control intelligence 28 commences with the control intelligence in a Start Up-Sleep Mode state block 34. From that block 34, the control intelligence is awakened and asks itself which of three alternative signals awakened it. The first possible awakening signal is represented by an Awakened By Power Up decision block 36. If the answer is yes, such as when a power source is connected to the control intelligence means 28, the control intelligence goes back to the start up-sleep mode. If the answer is no, the second possible awakening signal is represented by Awakened By Watch Dog Timer decision block 38. If the answer to decision block 38 is no, the third possible awakening signal is represented by Awakened By Vibration Sensor decision block 40.

For purposes of explanation, operation of the system control intelligence means 28 will be further described by first exploring the tasks and decisions of the control intelligence occurring when it is awakened by a standard watch dog timer 29, wherein the answer to decision block 38 is yes. In that event, as represented by a first Is Temperature Sensor Triggered decision block 42, the control intelligence 28 next interprets signals from the temperature sensor 22 to decide whether-or-not a specific high or trigger temperature has been sensed in the cooking housing 16. If the trigger temperature has not been sensed, the answer is no, and, as represented by the Clear Alarm Timer Running Flag task block 44, the control intelligence 28 clears a running flag, if set, that indicates the alarm timer 30 has been loaded, and returns to the start up-sleep mode. If the trigger temperature has been sensed, the answer to decision block 42 is yes and the control intelligence 28 then must decide whether the alarm timer running flag is set, as represented by decision block 46.

If the answer to decision block 46 is no, the control intelligence 28 then sets the alarm timer running flag and loads the alarm timer 30 to a base cycling count, as represented by task block 48. The control intelligence then returns to its start up-sleep mode. If the answer to decision block 46 is yes, the control intelligence 28 proceeds to decrease the alarm timer's cycling count by one count, as represented by task block 50. The control intelligence 28 then decides whether the alarm timer's cycling count is zero as represented by decision block 52. If the answer to decision block 52 is no, the control intelligence 28 returns to its start up-sleep mode. If the answer to decision block 52 is yes, the control intelligence activates the horn 26, as represented by task block 54.

Returning to the question of whether-or-not the control intelligence 28 was awakened by sensing signals generated by the vibration sensor 24, as represented by decision block 40, if the answer is yes, the control intelligence immediately deactivates the horn 26, as represented by task block 56, and then decides if the temperature sensor has sensed the specific high temperature, as represented by a second Is Temperature Sensor Triggered decision block 58. If the answer to decision block 58 is no, the control intelligence 28 returns to the start up-sleep mode. If the answer to decision block 58 is yes, the control intelligence 28 proceeds to re-set the alarm timer 30 to its base cycling count, as indicated by task block 60, and then returns to the start up-sleep mode.

In operation of the automatic temperature alarm system 10 in association with the barbecue 12, the system control intelligence 28 is first programmed so that the standard watch dog timer 29 awakens or cycles the control intelligence 28 at specific intervals of time, for example, every 2.5 seconds. Additionally, an alarm timer means for measuring an adjustable alarm period is used, such as the alarm timer 30 of microcontroller 28. A memory component of the alarm timer is initialized to receive and store a sequence of specific numbers, one of which may be for example 480, which specific numbers correlate to specific four bit binary numbers registered in the time switch, so that for example the number one correlates to the number 480 in the memory component of the alarm timer. The alarm timer 30 is loaded to the base cycling count described in task block 48 when the specific number set in the timer switch 32 is read by the microcontroller 28 to access and load the corresponding number from the memory component of the alarm timer 30 in to the C.P.U., in a manner well known in the art. For example if the base cycling count number stored in the memory component is 480, and the watch dog timer is set to cycle the control intelligence every 2.5 seconds, the alarm period or total time to reduce the alarm timers cycling count to zero and thereby activate the horn would be twenty minutes. If a longer or shorter duration alarm period is desired, a different number in the time switch is read by the microcontroller thereby corresponding to a specific number in the memory component, or a different base cycling count (e.g., 600 for a longer duration, or 300 for a shorter duration).

Before the barbecue 12 is ignited the temperature sensor senses a normal temperature so that every 2.5 seconds the watchdog timer awakens the system control intelligence 28 which immediately returns to its start up-sleep mode as indicated by the sequence of decision blocks 36, 38, 42 and task block 44. When an operator commences usage of the barbecue 12, contact with it is sensed by the vibration sensor 24 interrupting that sequence, and the system control intelligence 28 is awakened by the vibration sensor. But because the temperature sensor 22 is not sensing the specific high or trigger temperature, the control intelligence 28 immediately returns to its start up-sleep mode, as indicated by the sequence of decision blocks 36, 38, 40, and 58.

When the operator ignites the barbecue, and the temperature sensor 22 senses the high or trigger temperature of the cooking housing as been achieved, the control intelligence 28, after being awoken by the watch dog timer decides that the alarm timer running flag must be set, sets it and loads the alarm timer to its base cycling count of 480, and then returns to its start up-sleep mode, as indicated by the sequence of decision blocks 36, 38, 42, 46 and task block 48. In the next cycle initiated by the watchdog timer 2.5 seconds later, the control intelligence determines that the alarm timer running flag has been set and proceeds to decrease the alarm timer's cycling count by one count to 479, as indicated the sequence of decision blocks 36, 38, 42, 46 and task block 50. The following cycles initiated by the watch dog timer repeat that sequence until the alarm timer's cycling count is zero, approximately twenty minutes after the system control intelligence 28 set the alarm timer running flag. The control intelligence then decides the alarm timer is zero and activates the horn 54, as indicated by the sequence of decision blocks 36, 38, 42, 46, 52 and task blocks 50 and 54.

If the operator touches and thereby moves the barbecue during that twenty minute period, the vibration sensor senses the motion and awakens the control intelligence 28, determines that the temperature sensor is sensing a high temperature, and re-sets the alarm timer to its base cycling count of 480 before returning the control intelligence to its start up-sleep mode, thereby initiating a new twenty minute alarm period, as indicated by the sequence of decision blocks 36, 38, 40, 58 and task block 60. If the barbecue 12 is not touched during a twenty minute alarm period and the horn 26 is activated, movement of the barbecue by the operator immediately deactivates the horn as represented by the sequence of decision blocks 36, 38, 40, and task block 56, before re-setting the alarm timer to its base cycling count. As the operator turns the barbecue off and it cools off, the temperature sensor senses the temperature of the cooking housing 16 has declined below the high or trigger temperature, and the control intelligence clears the alarm timer running flag and unloads the alarm timer, as indicated by the sequence of decision blocks 36, 38, 42, and task block 44, before returning to its start up-sleep mode. Consequently, with no requirements for any operator activity, the automatic temperature alarm system 10 of the present invention monitors the temperature of the heated apparatus and alerts the operator in the event the apparatus has been heated and untouched for an excessive period of time.

It should be understood by those skilled in the art that while the present invention has been described and illustrated with respect to a particular construction and embodiment, the invention is not limited to this particular example. For example, the automatic temperature alarm system may be utilized with a variety of heated apparatus that normally experience some vibration or motion during operation, such as the system being built into stove surfaces, manual heating equipment such as torches and welding apparatus, etc. Accordingly, reference should be made primarily to the attached claims rather than the foregoing specification.

I claim:

1. An automatic temperature alarm system for alerting an operator of a heated apparatus that the apparatus has been heated for an alarm period of time, comprising:

a. a temperature sensor affixed to the heated apparatus that senses temperatures of the heated apparatus;

b. a vibration sensor affixed to the heated apparatus that senses motion of the heated apparatus;

c. a horn to alert the operator; and d. a system control intelligence means in communication with the temperature sensor, vibration sensor and horn for setting an alarm timer to commence measurement of the alarm period in response to a sensed high temperature, for activating the horn upon expiration of the alarm period, and for re-setting the alarm timer to re-commence measurement of the alarm period upon sensing a motion in the heated apparatus.

2. The automatic temperature alarm system of claim 1, wherein the system control intelligence means is a microcontroller.

3. The automatic temperature alarm system of claim 2, wherein the heated apparatus is a barbecue device.

4. An automatic temperature alarm system, comprising:

a. a temperature sensor affixed to a heated apparatus that senses temperatures of the heated apparatus;

b. a vibration sensor affixed to the heated apparatus that senses motion of the heated apparatus;

c. a horn to alert an operator of the heated apparatus that the apparatus has been heated for an alarm period of time; and d. a system control intelligence means in communication with the temperature sensor, vibration sensor and horn for setting an alarm timer to measure the alarm period in response to a sensed high temperature, for activating the horn upon expiration of the alarm period, for re-setting the alarm timer to measure the alarm period upon sensing a motion in the heated apparatus, and for deactivating the activated horn, so that;

the system control intelligence means sets the alarm period whenever the intelligence means senses from the temperature sensor a temperature in excess of a trigger temperature of the heated apparatus;

the system control intelligence means activates the horn to alert the operator whenever the alarm period expires;

the system control intelligence means re-sets the alarm period whenever the intelligence means senses from the vibration sensor motion of the heated apparatus; and the system control intelligence means deactivates the activated horn whenever the intelligence means senses from the vibration sensor motion of the heated apparatus.

5. The automatic temperature alarm system of claim 4, wherein the system control intelligence means is a microcontroller.

6. The automatic temperature alarm system of claim 5, wherein the heated apparatus is a barbecue device.

7. A method of alerting an operator of a heated apparatus that the heated apparatus has been heated for an alarm period of time, comprising the steps of;

a. sensing temperatures of the heated apparatus with a temperature sensor;

b. sensing motion of the heated apparatus with a vibration sensor;

c. communicating the sensed temperatures and sensed motions to a system control intelligence;

d. operating the system control intelligence to set an alarm timer to commence measurement of the alarm period whenever a temperature in excess of a trigger temperature of the heated apparatus has been sensed by the temperature sensor, to activate a horn to alert the operator upon expiration of the alarm period, and to re-set the alarm timer to re-commence measurement of the alarm period whenever the vibration sensor senses motion of the heated apparatus.

8. The method of claim 7, including the further step of operating the system control intelligence to inactivate the activated horn whenever the system control intelligence senses from the vibration sensor motion of the heated apparatus.

9. The method of claim 8, including the further step of operating the system control intelligence to inactivate the alarm timer whenever the system control intelligence senses a temperature below the trigger temperature.

10. The method of claim 9, wherein the step of operating the system control intelligence comprises operating a microprocessor to set the alarm timer to commence measurement of the alarm period whenever a temperature in excess of a trigger temperature of the heated apparatus has been sensed by the temperature sensor, to activate the horn to alert the operator upon expiration of the alarm period, and to re-set the alarm timer to re-commence measurement of the alarm period whenever the vibration sensor senses motion of the heated apparatus.

* * * * *